United States Patent [19]

Furter

[11] 4,098,226

[45] Jul. 4, 1978

[54] POWDER-COATING APPARATUS

[75] Inventor: Walter Furter, Niederlenz, Switzerland

[73] Assignee: Hero Conserven Lenzburg, Lenzburg, Switzerland

[21] Appl. No.: 770,297

[22] Filed: Feb. 22, 1977

[30] Foreign Application Priority Data

Feb. 20, 1976 [CH] Switzerland ..... 2130/76

[51] Int. Cl.[2] ..... B05B 5/02

[52] U.S. Cl. ..... 118/622; 118/317; 118/624; 118/630; 239/15; 239/500

[58] Field of Search ..... 118/312, 317, 622, 624, 118/630; 239/15, 500, 504; 427/28, 33

[56] References Cited

U.S. PATENT DOCUMENTS

| | | | |
|---|---|---|---|
| 1,674,480 | 6/1928 | Nelson | 239/500 X |
| 1,745,297 | 1/1930 | Harry | 239/504 |
| 3,045,921 | 7/1962 | Heuschkel | 239/15 X |
| 3,590,318 | 6/1971 | Probst et al. | 239/15 X |
| 3,633,544 | 1/1972 | Weiler | 118/312 X |
| 3,782,636 | 1/1974 | Donnelly | 118/317 X |

*Primary Examiner*—Robert R. Mackey

*Attorney, Agent, or Firm*—Larson, Taylor and Hinds

[57] ABSTRACT

Apparatus for powder coating the inside of can bodies, either along a strip or completely, comprises a spray head having an inlet opening fed through a gun with a powder-air mixture and an exit opening located so as to deliver the powder-air stream transversely to the gun axis onto the can body. The exit opening is either a slot-type nozzle for applying a strip, or an annular opening for a complete coating of the can. So as to apply the coating in a precisely limited form without rebound, insert baffles in the form of rods are fixed in the spray head passage which expands between the entry and exit openings to slow down, distribute and orient the powder-air stream towards the exit opening. A deflector wall is located at the end of the passage to deflect the powder-air stream towards the exit opening. Where the slot-type nozzle is used, the powder-air stream may enter an antichamber having an outlet slot parallel to the nozzle and a further slot opening into the passage beyond the antichamber to be deflected into the portion of the nozzle beyond the antichamber by a series of inclined deflector walls. A separate stream of air, separate from the powder-air stream, may be fed into the passage beneath these deflector walls.

8 Claims, 9 Drawing Figures

POWDER-COATING APPARATUS

FIELD OF THE INVENTION

The invention relates to an apparatus for powder-coating at least a part of a body, particularly a hollow body such as a can body. The apparatus comprises a spray gun provided with a spray head for spraying a powder-air current, the spray head having a flow passage widening from an entry opening to an exit opening lying transversely thereof, and the wall of this passage lying opposite to the entry opening serving for deflection and being formed at an inclination to the axis of the entry opening.

DESCRIPTION OF THE PRIOR ART

Containers, especially cans, of metal for foodstuffs and semi-luxuries and for the paint industry must be coated on their insides with a layer protecting the container material, for example with a varnish, in order to prevent the filling from attacking the container and the latter becoming leaky, or the filling being modified by the action of metal, or no longer conforming with the food stuff law.

Thus, by way of example, for the production of cans from metal, either firstly a metal sheet is coated with varnish and then the can is produced, or firstly the can is produced and then it is coated with varnish. In the former case, parts devoid of varnish occur where the can is soldered or varnished and furthermore the coated surface can be damaged by splashes of solder or welding metal. Therefore, according to the conventional methods the unprotected seam of a can body must be sprayed over afresh with varnish before or after soldering (directly afterwards in the case of welding). The varnish requires a hardening time of 3 to 7 days. Elimination of the hardening time would be possible only by the use of an extensive and expensive stoving plant.

The long hardening time involves not only extra labor and thus also cost, but also considerably interferes with the continuous flow of production. Nevertheless the use of such a can for food or semi-luxuries, even after this hardening time, cannot in every case eliminate deterioration of the taste of the filling due to the varnish layer. Therefore, there has long been a distinct need for a satisfactory internal coating of containers, especially cans.

U.S. Pat. No. 3,526,027 describes an electrostatic powder-coating method in which the seams of container bodies are provided with a covering during their production. In this case, on a pre-heated vessel body an electrostatically charged powder is applied by means of an air current by a spraying head to the seam of the container body, and then fused onto the container in a melting device. This method has not hitherto become established in practice in the production of preserved food cans. It is the problem of the invention to produce a powder coating apparatus by means of which a satisfactory powder coating is possible, particularly inside a hollow body such as a container body.

SUMMARY OF THE INVENTION

According to the invention, a powder-coating apparatus as defined in the above outline of the field of the invention has insert baffles distributed over the flow cross-section in the spray head for slowing down, distributing and orienting the powder-air stream in relation to the exit opening.

Due to the fact that the spray head comprises inserts distributed over the flow cross-section for braking, distributing and orienting the powder-air current, the powder-air stream or current can be so slowed down and distributed that it does not rebound from the body to be coated, and can be applied in a precisely limited form.

Conventional powders of synthetic plastic material, for example epoxy resins, can be used for the coating. When the powders are used for cans for foodstuffs and semi-luxuries, they can easily be adjusted so that they conform with the provisions of the appropriate food stuff laws and regulations. The powder-coating apparatus is preferably equipped with a device for the electrostatic charging of the powder to be applied. Powders which are not electrostatically charged may also be applied.

With the powder-coating apparatus, hollow bodies and especially containers such as cans can be provided with an effective and practical internal coat either overall or along a strip. The coating can be made so thick and regular that even edges, such, for example, as seams, and especially creases of container bodies can be covered satisfactorily. Powder coatings are immediately ready after the fusion of the powder, and require no time for hardening. This is important especially for the food stuff and semi-luxury industry, because cans can be internally coated rationally and satisfactorily, entirely or at least along a seam. Such coatings preferably also do not deposit any health-harmful or taste-detrimental substances which could impair the contents. Moreover, in the coating, excess powder can for the most part be sucked away, precipitated in a cyclone and reused after filtering. Moreover, the powder coating is environmentally compatible, since no solvents are released.

Examples of powder-coating apparatus according to the invention and its use will be described in detail hereinafter with reference to the accompanying drawings in which.

Figure 1:
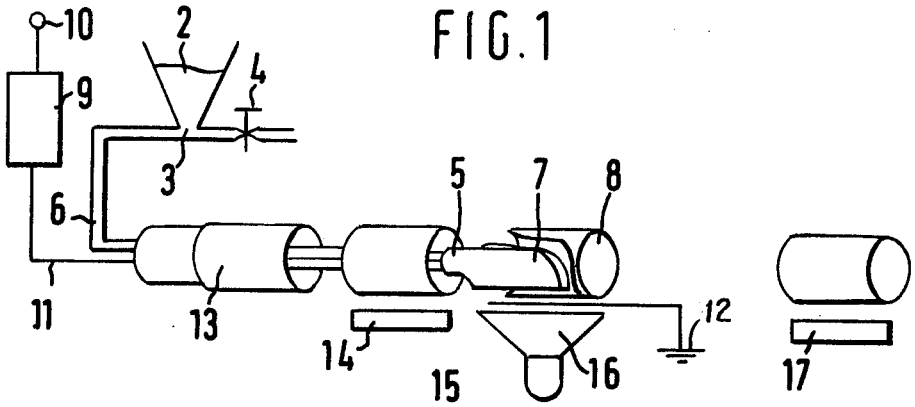
FIG. 1 is a diagram of powder-coating apparatus for coating in a downward direction.

As shown in FIG. 1, a powder-coating apparatus 1 comprises a powder container 2 opening into an injector device 3. The latter is connected through a compressed-air regulating device 4 with a compressed-air source (not shown). A spray gun barrel 5 is connected by way of a powder/air conduit 6 to the injector device 3. At its front end the spray gun barrel 5 carries a spray head 7 which can take various forms according to the purpose of the powder-coating apparatus 1. The spray head is so arranged that it can extend into a hollow body to be coated, in the present example into a can body 8. The above-described elements form the mechanical-pneumatic part of the powder-coating apparatus. The electric part of the powder-coating apparatus comprises a control device 9 and a high-tension generator which is arranged in the spray gun. The control device 9 is connected through a terminal 10 with the mains and through a lead 11 with the high-tension generator in the spray gun. An earth connection 12 is provided for the can body 8.

The powder-coating apparatus as described is arranged in known manner in an installation for the production of can bodies 8. As appears diagrammatically from FIG. 1, the can bodies are shaped at a forming station 13 from a cut-out sheet metal piece, and either soldered or welded at the seam. If necessary, a pre-heating station 14 serves for the pre-heating of the seam to be coated, which is then coated with the powder in the coating station 15 by means of the spray gun having the spray head 7. A suction device 16 serves to suck away excess powder. The earth connection 12 maintains the required potential difference between the electrically charged powder and the can body. Next follows a melting station 17 in which the powder is caused to fuse by the action of heat.

Some especially advantageous forms of spray head are described in greater detail below. In all these forms the spray head 7, for attachment to the spray gun, has a flow passage which widens from its entry opening to its exit opening. The exit opening is arranged transversely of the entry opening, and a wall lying opposite to the entry opening and at an inclination to its axis serves for deflection of powder and air towards the exit opening. Moreover, in the flow passage there are arranged inserts distributed over the flow cross-section which brake and distribute the powder-air flow and orient it in relation to the exit opening.

Figure 2:
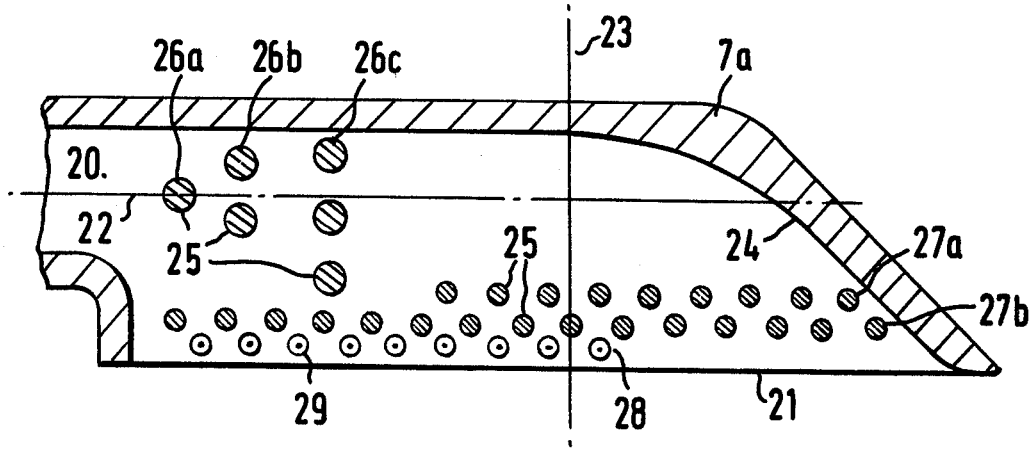
FIG. 2 shows in vertical longitudinal section a spray head for a spray gun for applying a coating in strip form in a downward direction.
Figure 3:
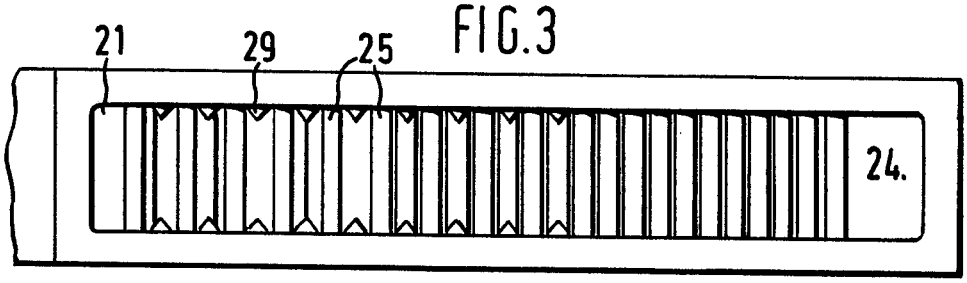
FIG. 3 is a plan view of the spray head of FIG. 2 as viewed from below.

In the form represented in FIGS. 2 and 3, the spray head *7a* has an entry opening 20 with circular cross-section and the exit opening 21 is formed as a slot-type nozzle extending parallel with the axis 22 of the entry opening. In the region of the exit opening, the cross-section 23 of the spray head is substantially U-shaped. The deflector wall 24 of the flow passage lying opposite to the entry opening is inclined and serves for the deflection of the powder-air flow.

Constituting a portion of the aforesaid inserts are a set of transverse bars 25 allocated to the entry opening 20, which are arranged in three rows *26a, 26b, 26c* and lie transversely of the axis 22 of the entry opening 20 and parallel to the exit opening 21. The transverse bars of one row are aligned and in each case staggered in relation to the transverse bars of an adjacent row, and the row *26a* facing the entry opening 20 has less transverse bars 25 than the other rows *26b* and *26c*. The number and arrangement of the transverse bars 25 are determined according to the speed of the powder-air flow and the speed at which the can bodies to be coated are delivered to the nozzle.

Constituting another portion of the aforesaid inserts are a further set of transverse bars 25 allocated to the exit opening 21, where they are arranged in two rows *27a, 27b*. The transverse bars of one of these rows are arranged in staggered relation to the transverse bars of the other row. The inner row *27a* is shorter than the outer row *27b*, which extends over the whole length of the exit opening, and is close to the exit opening 21. In the region of the exit opening 21 remote from the deflector wall 24, outside the outer row *27b* of transverse bars 25 there is also arranged a row 28 of cone-type protuberances 29 on the two side walls of the flow passage. These cone-type protuberances 29, which can extend either to a greater or lesser extent into the exit opening 21, are arranged in staggered relation to the transverse bars 25 of the outer row *27b*. The protuberances 29 serve to avoid the wall-jet effect, that is a concentration of the powder-air stream on the wall of the exit opening 21, and to direct the powder-air stream towards the middle region of the exit opening.

For further influencing of the powder-air stream, the transverse bars 25 can have a cross-sectional form that varies over their length. Thus, by way of example, one part of the transverse bars, preferably those transverse bars associated with the entry opening 20, can be tapered in the middle region in order to deflect the powder-air stream towards the middle region of the flow passage and concentrate it there.

The spray head as shown in FIGS. 2 and 3 serves preferably for coating in a downward direction to produce a coating in strip form on a can body. The spray head as shown is moreover also suitable for the production of other partial internal and external coatings on articles. The powder-air stream arriving through the entry opening 20 rebounds firstly upon the first set *26a, 26b, 26c* of transverse bars 25 and is subjected to a braking effect, distributed and partially deflected in the direction towards the exit opening 21. The part of the powder-air current which is not yet deflected towards the exit opening strikes the deflector wall 24 lying opposite to the entry opening 20, where this part of the current is likewise deflected to the exit opening 21. A further braking effect, deflection and distribution of the powder-air current is effected adjacent the exit opening 21 by the further set *27a, 27b* of transverse bars 25. In the part of the exit opening 21 close to the deflector wall 24, the transverse bars 25 in the two rows *27a, 27b*, act so as strongly to brake and distribute the powder-air stream which is comparatively powerful in that region of the spray head. Additional flexible deflecting strips can be arranged on both sides of the exit opening 21 as shown for the spray head in FIGS. 5 to 7.

Figure 4:
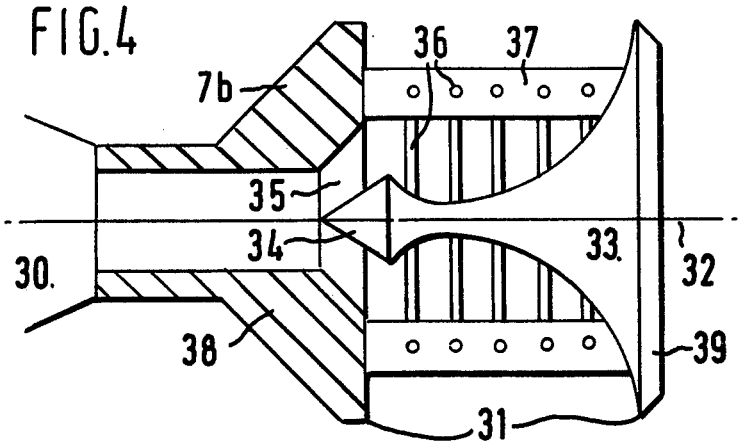
FIG. 4 shows an elevation, partly in section, of a spray head for the complete internal coating of a can.

FIG. 4 shows another form of spray head *7b* to be attached to the spray gun barrel 5. In this spray head *7b* an entry opening 30 is connected through a flow passage with an exit opening 31 which is made annular or in the form of a cylindrical jacket and arranged coaxially with the axis 32 of the entry opening 30 and transversely of the latter. A deflector wall 33 lying opposite to the entry opening is made in the form of a cone defined by a concave surface of revolution. The axis of the cone coincides with the axis 32 of the entry opening 30. The wall 33 serves for the deflection of the powder-air stream to the exit opening 31. The expanding apex of this deflector wall 33 is truncated and joins the base of a comparatively small distributor cone 34 which protrudes into a widened part 35 of the entry opening 30.

In this spray head *7b*, several annular transverse bars 36 are arranged as inserts within and concentric with the exit opening 31. These annular bars are mounted transversely of the axis 32 of the entry opening 30. The transverse bars 36 are held in longitudinal strips 37 which are made as narrow as possible in the radial direction with respect to the transverse bars in order not to disturb the powder-air stream. The longitudinal strips 37 of the spray head 7*b* extend between an expanded part 38 of the wall of the entry opening 30 and a base part 39 of the conical deflector wall 33.

The spray head 7*b* as shown in FIG. 4 serves for the complete internal coating of a can body. The powder-air current flowing in through the entry opening 30 experiences a first braking effect and deflection due to the additional distributor cone 34. After further braking and deflection by the conical deflector wall 33 and the transverse bars 36, the powder-air current, slowed down and guided, issues from the spray head 7*b* through the exit opening 31.

Figure 5:
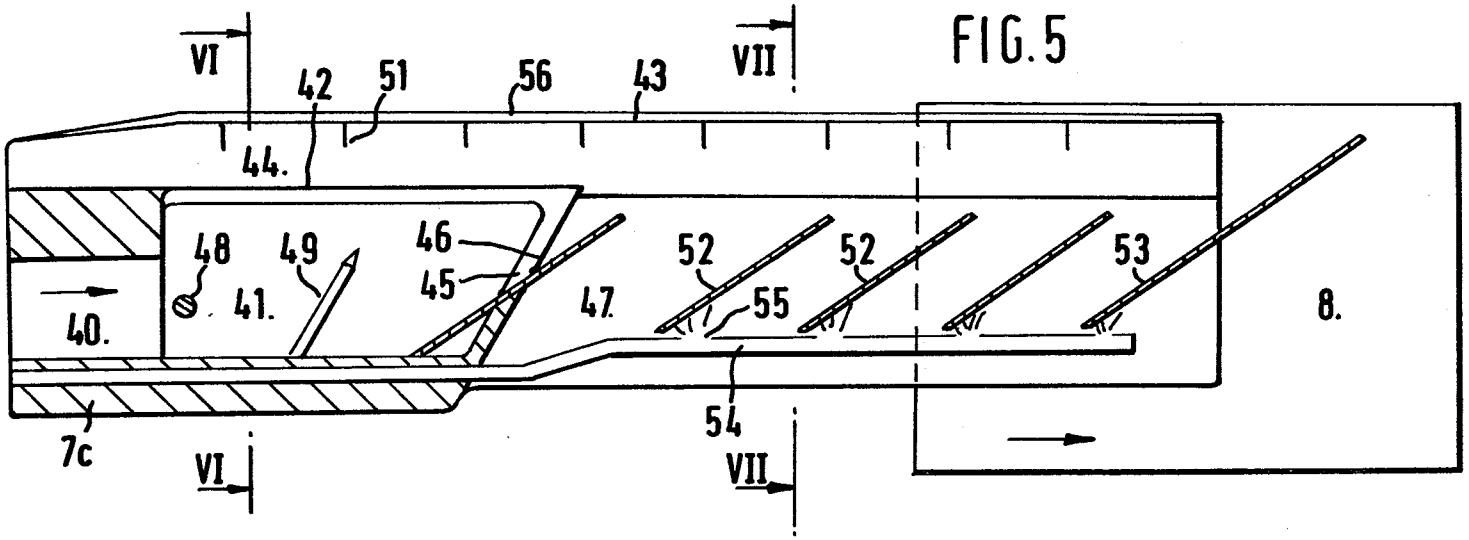
FIG. 5 shows in vertical longitudinal section a further spray head for a spray gun for applying a coating in strip form in an upward direction.
Figure 7:
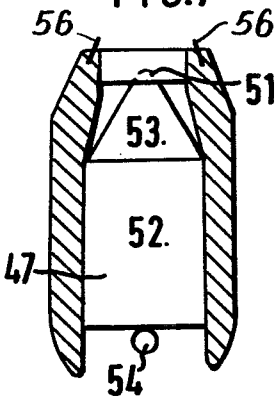
FIG. 7 shows a cross-section on the line VII—VII in FIG. 5.
Figure 6:
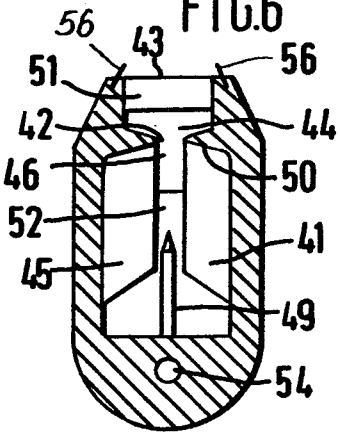
FIG. 6 shows a cross-section on the line VI—VI in FIG. 5.

FIGS. 5 to 7 show a preferred spray head 7*c* for the internal coating of a seam of a can body 8, the seam being located above the spray head. The spray head contains an antechamber 41 arranged towards an entry opening 40 and having in its upper wall 50 a longitudinal slot 42 which opens into a widening longitudinal passage 44 beneath a slot-type nozzle 43. A deflector wall 45 of the antechamber 41, lying opposite to the entry opening 40, likewise contains a slot 46 which merges into and continues the upper longitudinal slot 42. The longitudinal slot 46 of the deflector wall 45 opens into a widening distributor passage 47. The antechamber 41 moreover comprises a transverse bar 48 lying close to the entry opening 40 and located transversely with respect to the slot-type nozzle 43, which bar effects a preliminary braking effect and division of the powder-air stream entering the spray head. A further transverse bar 49 is spaced from and parallel with the deflector wall 45, which bar 49 lies perpendicularly to the transverse bar 48 and effects a further division and deflection of the powder-air stream. The transverse bar 49 furthermore assists the deflection of the powder-air stream towards the slot-type nozzle 43. The upper wall 50 containing the longitudinal slot 42 and the deflector wall 45 containing the longitudinal slot 46 are bevelled off towards the slots 42 and 46 in order to facilitate the detachment from these walls of the powder-air stream flowing along the walls, and to prevent the formation of pockets of powder.

The powder-air stream flowing out of the entry opening 40 into the antechamber 41 experiences in the antechamber a first expansion and deflection towards the slot-type nozzle 42. The powder-air stream issuing through the upper longitudinal slot 42 arrives in the widening longitudinal passage 44 and is there further smoothed and slowed down, so that finally it can issue from the slot-type nozzle 43. For further controlled guidance of the powder-air stream to and through the slot-type nozzle 43, the latter is equipped with a row of flat transverse bars 51.

The powder-air stream entering the distributor passage 47 from the slot 46 in the deflector wall 45 encounters various deflector walls 52 arranged in series and inclined towards the slot-type nozzle 43. The arrangement of the deflector walls 52 should be arranged so that the lower end of each deflecting wall does not lie substantially beyond the upper edge of any adjacent proceeding deflector wall. The deflector walls preferably overlap. The last deflector wall 53 preferably reaches to the level of the slot-type nozzle 43. The distributor passage 47 opens into the longitudinal passage 44 and thus into the slot-type nozzle 43. This zone of the slot-type nozzle too is provided with transverse bars 51 which deflect the powder-air current of the distributor passage 47 in the slot-type nozzle 43 towards the can body to be coated. The distributor passage 47 is open on its lower side remote from the slot-type nozzle 43, so that air can be sucked by a suction device at a coating station out of the open part of the distributor passage 47, which air is directed on the under side of the deflector walls 52, 53 and forms a carrier air current for the powder-air current to the slot-type nozzle 43. The spray head may have a conduit 54 for an additional air current, which conduit extends through the distributor passage 47 and has discharge openings 55 directed towards the under side of the deflector walls 52, 53. By means of the additional air current a carrier air current can be produced on the under sides of the deflector walls 52, 53, serving to support the powder-air current on the way to the slot-type nozzle 43.

Both the slot-type nozzle 43 and the longitudinal passage 44 are open at the front and rear ends of the spray head in order to prevent a build-up of the powder-air current in the spray head while coating and to facilitate the sucking away of the air current and excess powder by means of a suction device.

On both sides of the slot-type nozzle 43 there are arranged flexible limiting strips 56 which can slide on the can body during the coating operation and laterally limit the coating.

Figure 8:
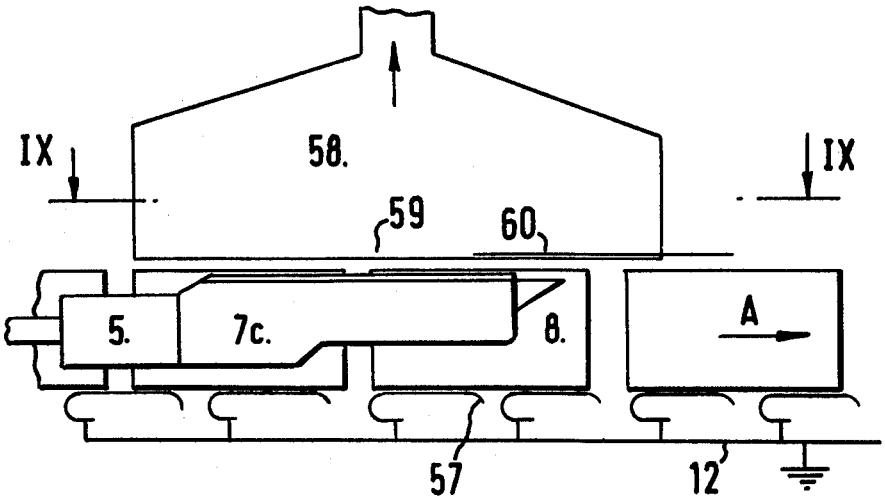
FIG. 8 shows diagrammatically a coating station for applying strip coatings internally to a series of cans.
Figure 9:
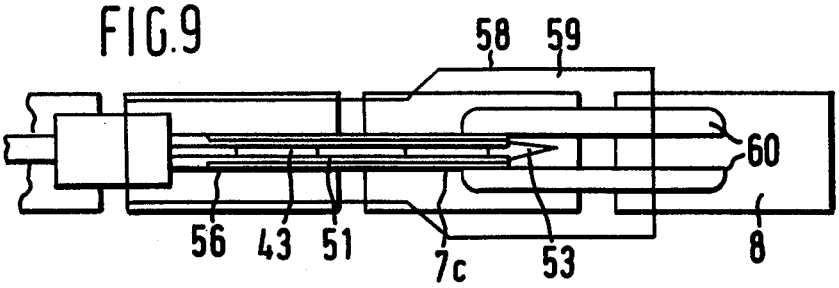
FIG. 9 shows diagrammatically a section on the line IX—IX in FIG. 8.

FIGS. 8 and 9 show a coating station with a spray head 7*c* of the kind as shown in FIGS. 5 to 7 arranged therein. The spray head lies within the can bodies 8, which are moved in the direction A by means of a conveyor device (not shown) and slide over contact strips 57 by means of which they are connected to earth at 12. The coating station comprises a suction hood 58 arranged above the can bodies, the suction slot 59 of which hood faces the spray head 7*c* and lies close above the can bodies 8. The suction slot is provided with covering strips 60 extending on both sides of the intended coating width and from an end zone of the spray head 7*c* to outside the suction hood 58. These covering strips prevent the suction air current from acting upon the powder-coated can bodies and sucking away the already applied powder again.

It is advantageous to adapt the spray head and the speed of conveying of the can bodies to one another in such a way that the powder issuing from the spray head has a speed component which at least approximately corresponds to the speed at which the can bodies are conveyed. This results in a regular and low-loss application of the powder. The sucking away of the powder by means of the suction hood can, if necessary, also be used for the control of the powder-air current.

The can bodies thus produced are distinguished by an especially advantageous, precisely limited coating. The coating is of regular thickness, even at the edges of the seams. Moreover, the coating requires no long hardening time, but is immediately effective after the melt has set. Particularly in the case of soldered can bodies, distortion-free seams result, because the air current serving for conveying the powder counteracts the unilateral external cooling that usually occurs beyond the soldering station or the reheating station, and thus counteracts the distortion of the seam, from the interior.

I claim:

1. Apparatus for powder coating at least a portion of a body, the apparatus comprising a spray gun barrel for the delivery axially with respect to said barrel of a gas stream containing suspended powder therein, a spray head mounted on said spray gun barrel so as substantially to constitute a continuation of said spray gun, said spray head being formed with an expanding passage having an entry opening for the entry into said passage of the powder-gas stream delivered by said gun barrel and also having an exit opening located laterally in said spray head for the delivery of the powder-gas stream in a direction transversely to the axis of said gun barrel onto the body, said spray head being further formed with a deflect wall located at an end of said passage opposite said entry opening and inclined so as to deflect a portion of the gas stream reaching said wall toward said exit opening, insert baffles fixed in said passage and distributed across the path therethrough traversed by the powder-gas stream in passing from said entry opening to said exit opening, for slowing down, distributing and orienting the powder-air stream in relation to said exit opening, said exit opening being formed in said spray head as a first slot-type nozzle extending at least approximately parallel to the axis of said entry opening, said spray head passage being formed so that said exit opening is displaced substantially to one side of the powder-air stream that is discharged by said entry opening when the apparatus is in use, and said spray head being further formed with internal walls defining an antechamber located to receive the powder-air stream discharged from said entry opening, said internal walls being formed with a second slot-type nozzle approximately parallel to said first slot-type nozzle and said internal walls comprising said deflector wall positioned to deflect the powder-air stream though said second slot-type nozzle and then through said first slot-type nozzle to the body to be coated, said antechamber being formed so as to extend only part of the distance from said entry opening to the remote end of said first slot-type nozzle and of said spray head passage.

2. Apparatus according to claim 1, in which said spray head is formed with parallel walls defining said first slot-type nozzle and providing openings at opposite ends through which said first slot-type nozzle is in communication with the atmosphere surrounding said spray head by way of said openings at said ends of said parallel walls.

3. Apparatus according to claim 1, in which said deflector wall is formed with a slot approximately in the median plane of said first and second slot-type nozzles through which slot a portion of the powder-air stream can pass to a location beyond said antechamber and within said passage but outside a portion of said first slot-type nozzle extending beyond said antechamber, and said spray head including at least one further deflector wall located to deflect said portion of the powder-air stream through said portion of said first slot-type nozzle.

4. Apparatus according to claim 1, in which said insert baffles include a bar fixed in said antechamber some distance up-stream from said deflector wall in the median plane of said first and second slot-type nozzles and approximately parallel with said deflector wall, said deflector wall being formed with a slot through which a portion of the powder-air stream can pass to a location beyond said antechamber and within said passage but outside a portion of said first slot-type nozzle extending beyond said antechamber, and said spray head including at least one further deflector wall located to deflect said portion of the powder-air stream through said portion of said first slot-type nozzle.

5. Apparatus according to claim 1, in which said deflector wall is formed with a slot through which a portion of the powder-air stream can pass into a portion of said spray head passage extending beyond said antechamber and said spray head including a series of further deflector walls mounted to deflect said portion of the powder-air stream through said first slot-type nozzle.

6. Apparatus according to claim 1, in which said deflector wall is formed with a slot through which a portion of said powder-air stream can pass into a portion of said spray head passage beyond said antechamber, said spray head being formed with a longitudinal opening on a side thereof opposite to a side thereof formed with said first slot-type nozzle, and said spray head being furnished in said portion of said spray head passage with a series of overlapping inclined further deflector walls for deflecting said portion of the powder-air stream through said first slot-type opening beyond said antechamber, said further deflector walls being respectively at increasing distances from said antechamber with the terminal deflector wall extending from said opening in said spray head passage substantially to said first slot-type nozzle.

7. Apparatus according to claim 1, including means for delivering an additional stream of air along said spray head independently of said powder-air stream from a point adjacent said entry opening to a point beyond said antechamber on the side of said spray head passage remote from said first slot-type nozzle, said means being arranged to emit the additional stream at said point across said passage towards said first slot-type nozzle and said antechamber being formed with a slot for the passage of a portion of the powder-air stream to join the additional air-stream in said passage.

8. Apparatus for internal powder coating of container bodies, the apparatus comprising a spray gun barrel for the delivery axially with respect to said barrel of a gas stream containing suspended powder therein, a spray head mounted on said spray gun barrel so as substantially to constitute a continuation of said spray gun, said spray head being formed with an expanding passage having an entry opening for the entry into said passage of the powder-gas stream delivered by said gun barrel and also having an exit opening located laterally in said spray head for the delivery of the powder-gas stream in a direction transversely to the axis of said gun barrel onto a body, said spray head being further formed with a deflect wall located at an end of said passage opposite said entry opening and inclined so as to deflect a portion of the gas stream reaching said wall toward said exit opening, insert baffles fixed in said passage and distributed across the path therethrough traversed by the powder-gas stream in passing from said entry opening to said exit opening, for slowing down, distributing and orienting the powder-air stream in relation to said exit opening, said exit opening being formed in said spray head as a slot-type nozzle extending at least approximately parallel to the axis of said entry opening, a suction hood formed with a suction slot arranged opposite said slot-type nozzle of said spray head, means for feeding cylindrical container bodies continuously over said spray head with portions of the walls thereof passing between said suction slot and said slot-type nozzle and two cover strips mounted parallel to said slot-type nozzle with parallel edges separated by an amount equal to the width of a coating to be applied inside each container body by said suction head, said cover strips extending from an end region of said spray head remote from said gun barrel to a point outside said suction hood.

* * * * *